US012545473B2

(12) United States Patent
Reed et al.

(10) Patent No.: US 12,545,473 B2
(45) Date of Patent: Feb. 10, 2026

(54) SPILL PALLET

(71) Applicant: ENPAC, LLC, Eastlake, OH (US)

(72) Inventors: Timothy Reed, Twinsburg, OH (US); Lawrence Stanek, Akron, OH (US); James Vanmeter, Fairlawn, OH (US); Brian Walters, Cypress, TX (US)

(73) Assignee: ENPAC, L.L.C., Eastlake, OH (US)

( * ) Notice: Subject to any disclaimer, the term of this patent is extended or adjusted under 35 U.S.C. 154(b) by 124 days.

(21) Appl. No.: 18/701,369

(22) PCT Filed: Oct. 20, 2022

(86) PCT No.: PCT/US2022/047206

§ 371 (c)(1),
(2) Date: Apr. 15, 2024

(87) PCT Pub. No.: WO2023/069572

PCT Pub. Date: Apr. 27, 2023

(65) Prior Publication Data

US 2024/0417135 A1 Dec. 19, 2024

Related U.S. Application Data

(60) Provisional application No. 63/270,410, filed on Oct. 21, 2021.

(51) Int. Cl.
*B65D 19/00* (2006.01)

(52) U.S. Cl.
CPC ..... *B65D 19/0087* (2013.01); *B65D 2519/00014* (2013.01); *B65D 2519/00049* (2013.01);
(Continued)

(58) Field of Classification Search
CPC ..... B65D 2519/00014; B65D 2519/00049; B65D 2519/00273; B65D 2519/00308;
(Continued)

(56) References Cited

U.S. PATENT DOCUMENTS 5,020,667 A 6/1991 Bush
5,092,251 A * 3/1992 Hamaker ..... B65D 19/004 108/901
(Continued)

FOREIGN PATENT DOCUMENTS

CN 200630302669.2 † 12/2007
CN 200630302671.X † 12/2007
(Continued)

OTHER PUBLICATIONS

EP3683162 English translation (Year: 2020).*
(Continued)

*Primary Examiner* — Janet M Wilkens
(74) *Attorney, Agent, or Firm* — Rankin, Hill & Clark LLP

(57) ABSTRACT

A spill pallet including: a continuous, unitary, liftable sump-defining base having a bottom, side walls extending from and surrounding the bottom and terminating in an upper edge, a plurality of risers extending from the bottom, and a rim formed in the side walls below the upper edge; and at least one drum-supporting grate that is supportable on the plurality of risers and the rim of the base. Two fork channels that are accessible from a side of the base have a fork cavity height and a fork cavity width sufficient to permit the spill pallet to be lifted by a standard fork lift truck or by a standard pallet jack. The bases are configured such that they are stackable on and partially nestable within identical bases to form stacks, which can be shipped side-by-side as a partial load within a truck, trailer or container.

22 Claims, 11 Drawing Sheets

(52) U.S. Cl.
CPC ..... *B65D 2519/00273* (2013.01); *B65D 2519/00308* (2013.01); *B65D 2519/00338* (2013.01); *B65D 2519/008* (2013.01); *B65D 2519/0094* (2013.01); *B65D 2519/0096* (2013.01)

(58) Field of Classification Search
CPC .... B65D 2519/00338; B65D 2519/008; B65D 2519/0094; B65D 2519/0096; B65D 19/0087; B65D 7/045
USPC .... 108/51.11, 53.1, 53.3, 57.13, 57.16, 901; 206/386, 599, 821
See application file for complete search history.

(56) References Cited

U.S. PATENT DOCUMENTS

| | | | | |
|---|---|---|---|---|
| 5,307,931 | A | 5/1994 | Gillispie et al. | |
| 5,359,955 | A | 11/1994 | Grebenyuk | |
| 5,392,911 | A * | 2/1995 | Gillispie | B65D 90/24 206/386 |
| 6,349,656 | B1 | 2/2002 | Mitchell | |
| 6,382,108 | B1 | 5/2002 | Stanek et al. | |
| 6,745,704 | B2 * | 6/2004 | Carter | B65D 90/24 108/55.1 |
| 7,201,549 | B2 | 4/2007 | Long et al. | |
| 10,017,296 | B2 | 7/2018 | Burk | |
| 10,065,765 | B2 † | 9/2018 | Stanek | |
| 2003/0226479 | A1 * | 12/2003 | Carter | B65D 90/24 108/55.1 |
| 2010/0251940 | A1 * | 10/2010 | Jones | B65D 19/004 108/53.5 |
| 2021/0371161 | A1 * | 12/2021 | Bastian, II | B41J 3/28 |

FOREIGN PATENT DOCUMENTS

| | | | | |
|---|---|---|---|---|
| CN | 200630302672.4 | † | 12/2007 | |
| CN | 108423265 A | * | 8/2018 | B65D 19/40 |
| EP | 3683162 A1 | * | 7/2020 | B65D 21/045 |

OTHER PUBLICATIONS

International Search Report dated Feb. 16, 2023 filed in PCT/US2022/047206.

Video "ENPAC IBC 2000i Tote Spill Pallet—5469-YE—Spill Containment for Intermediate Bulk Containers", Jul. 26, 2022, (ENPAC), Not Uploaded, Available on the Internet at https://www.youtube.com/watch?v=pljXcWtefw0; cited in International Search Report.

Video "Spill Containment for IBCs, Tanks and Totes—Ultra-IBC Sill Pallet Plus", Jan. 6, 2011, (Ultratech International, Inc.), Not Uploaded, Available on the Internet at https://www.youtube.com/watch?v=JwFyDbmXxek; cited in International Search Repport.

Amazon.com, "Little Giant® Plastic Muck Tub | Durable & Versatile Utility Bucket with Handles | Muck Bucket | Durable Handles | 70 Quart | Lime Green", 4 pages, available at https://www.amazon.com/LITTLE-GIANT-PSB70LIMEGREEN-Limegreen-Utility/dp/B0024EC7M4?th=1 (AISN B0024EC7M4, first available Jan. 16, 2007), last accessed Feb. 5, 2025.†

Brady Worldwide, Inc., SPC a Brady Business | Brady | Sorbents &Spill Control | Fighting spills effectively, 5 pages, Sep. 22, 2014.†

* cited by examiner
† cited by third party

SPILL PALLET

BACKGROUND OF INVENTION

Field of Invention

The present invention relates to spill pallets. More particularly, the present inventions relates to spill pallets made of structural foam that are capable of supporting up to four drums and are configured to be liftable using fork lifts and pallet jacks.

Brief Description of Related Art

Spill pallets have been in use for many years. One popular example is the ENPAC Poly Slim-Line-4 Drum Spill Pallet (SKU: 5400-YE-D).

BRIEF SUMMARY OF THE INVENTION

The present invention provides an improved spill pallet that comprises a continuous, unitary, liftable base that defines a sump, and at least one drum-supporting grate that rests on the base. In a preferred embodiment, the entire spill pallet is made of structural foam, and is a capable of supporting up to four 55-gallon (~208 liter) drums. The bases of the spill pallets are nestable for compact storage and transportation. In a preferred embodiment, a base having a height of about 12.25" (~31.75 cm) that is nested onto a lower identical base only takes up only an additional 1.75" (~4.5 cm) or so of vertical space above the base into which it is nested. This allows a minimum of fifteen bases to be nested in a stack that can be accommodated in a truck or trailer. The lateral dimensions of the bases also preferably allow for side-by-side stack loading capability in a truck or trailer.

In a preferred embodiment, spill pallets according to the invention include fork channels that are wider than current spill pallet products available in the market. The wider fork channels allow the spill pallets to be liftable using pallet jacks with fixed, standard fork spacing, in addition to forklifts with adjustable fork spacing.

Spill pallets according to the invention can optionally include a drain on one or more of the lifting sides for easy draining. The sump capacity is preferably at least 66 gallons (~250 liters).

The foregoing and other features of the invention are hereinafter more fully described below, the following description setting forth in detail certain illustrative embodiments of the invention, these being indicative, however, of but a few of the various ways in which the principles of the present invention may be employed.

DETAILED DESCRIPTION OF THE INVENTION

Figure 1:
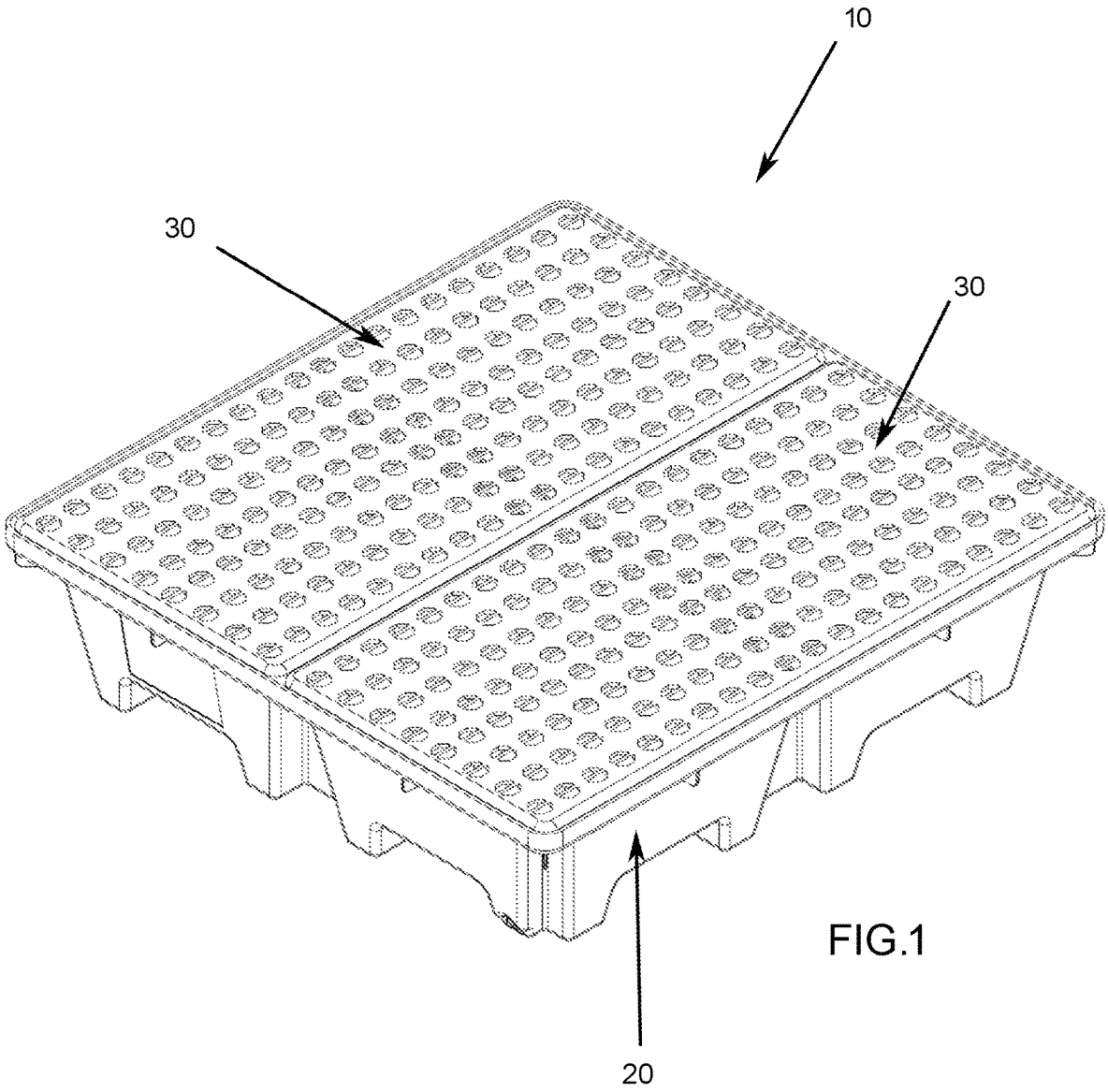
FIG. 1 is a perspective view of an exemplary embodiment of a spill pallet according to the invention.

As shown in FIG. 1, a spill pallet 10 according to the invention comprises a continuous, unitary, liftable sump-defining base 20 and one or more drum-supporting grates 30. In the preferred embodiment shown in FIG. 1, two grates 30 are provided. The grates are perforated to permit the passage of fluid that may leak or spill from drums or other containers supported on the grates 30.

The bases 20 and the grates 30 are both preferably formed of structural foam. In a preferred embodiment, the structural foam is thermoplastic structural foam, and comprises a high-density polyethylene resin into which a gas such as nitrogen has been introduced. The bases 20 and grates 30 are preferably formed by thermoplastic injection molding. The bases have a nominal wall thickness of about 0.25" (~0.64 cm). The grates 30 have a nominal thickness of about 1.5" (~3.8 cm). In a preferred embodiment, the spill pallet 10 weighs about 45 pounds (~20.4 kg).

Figure 2:
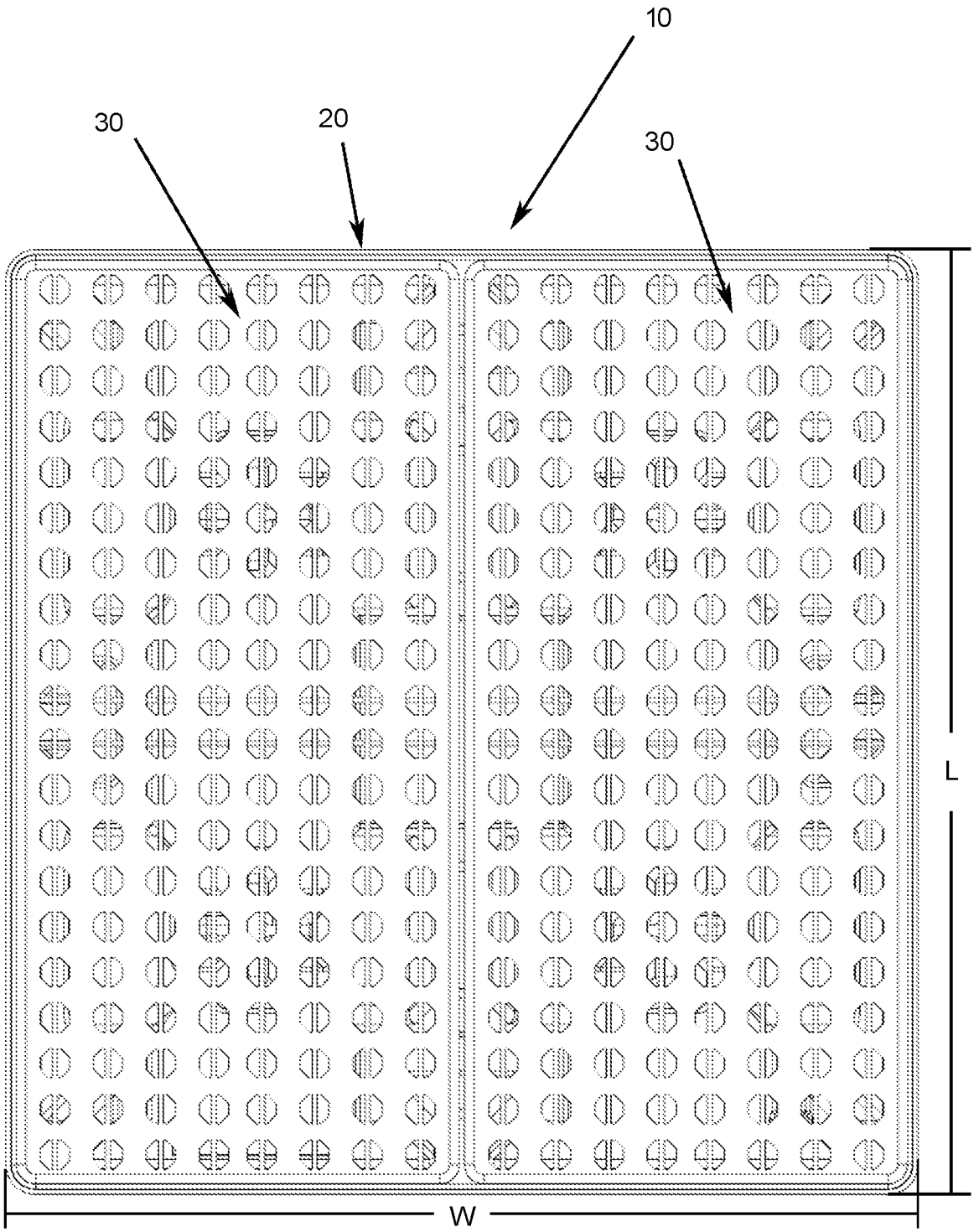
FIG. 2 is a top plan view of the spill pallet shown in FIG. 1.

FIG. 2 is a top plan view of the spill pallet 10 shown in FIG. 1. The two grates 30 are supported by the base 20 and thereby provide a flat surface above a sump, which can retain fluid that may leak or spill from the drums. In the illustrated embodiment, the two grates 30 can support up to four 55 gallon (~208 liter) drums. It will be appreciated that fluid-containing drums other than 55 gallon (~208 liter) can be supported on the grates 30.

Figure 3:
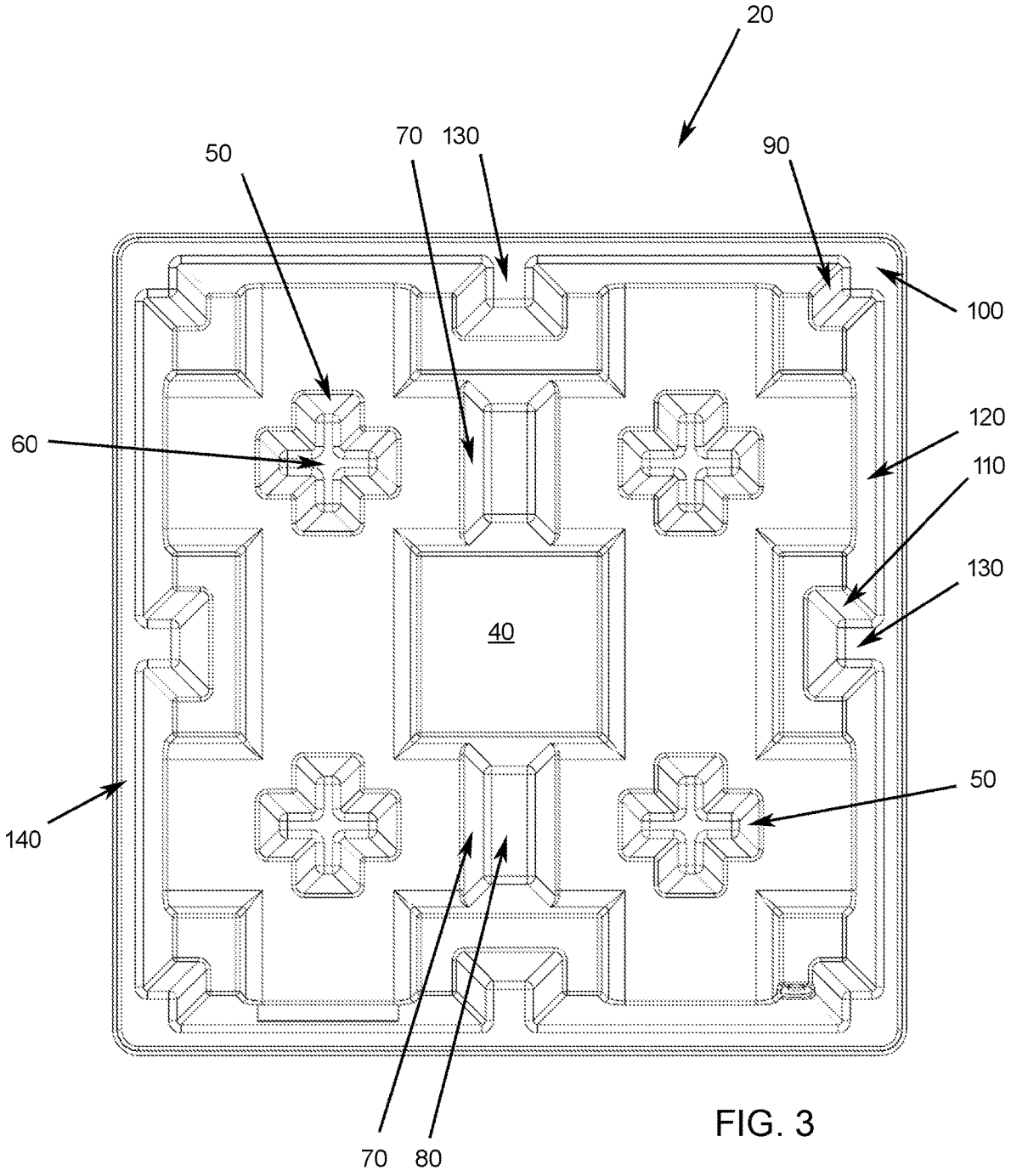
FIG. 3 is a top plan view of the base of the spill pallet shown in FIG. 1, with the grates removed.
Figure 4:
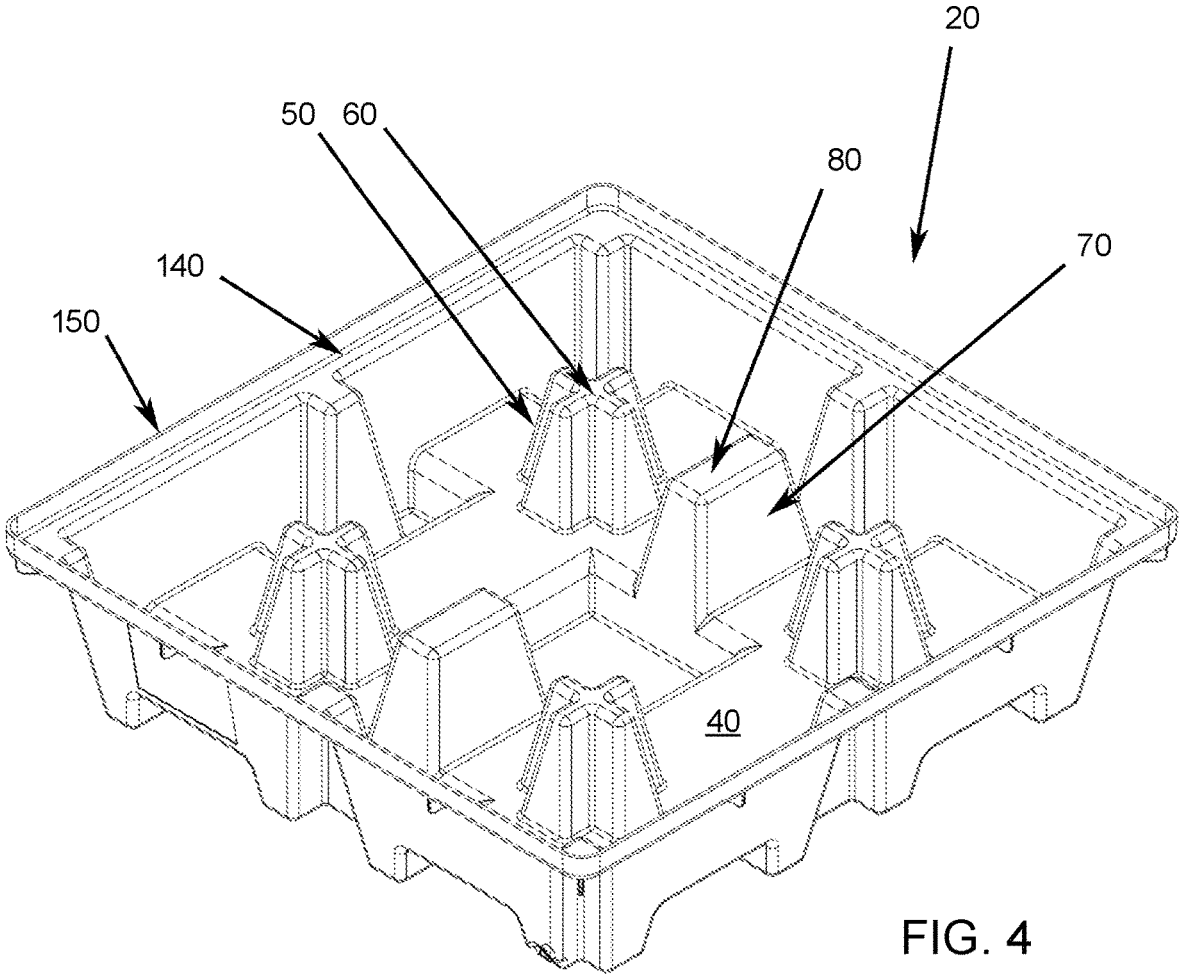
FIG. 4 is a perspective view of the base of the spill pallet shown in FIG. 3.

FIGS. 3 and 4 show a top plan view and a perspective view, respectively, of the base 20 of the spill pallet 10 shown in FIG. 1 with the grates 30 removed. The base 20 includes a bottom wall 40 and a plurality of risers 50, which extend upwardly from the bottom wall 40 and include a grate-supporting surface 60. In the preferred embodiment, four risers 50 are provided, and each includes a grate-supporting surface 60 that is in the shape of a Greek cross. In addition to the risers 50, a plurality of additional support structures 70 extend upwardly from the bottom wall 40. In the preferred embodiment, two additional support structures 70 are provided, and each includes a grate-supporting surface 80 that is rectangular in shape.

Corner pillars 90 are provided at each corner of the base 20. The corner pillars 90 each include a grate-supporting surface 100. In addition, side pillars 110 are provided in the sidewalls 120 of the base 20. The side pillars 110 also include a grate-supporting surface 130.

The base 20 also includes a rim 140, which is situated just below the upper edge 150 of the base 20. The rim 140 also serves as a grate-supporting surface.

In a preferred embodiment, the base has a sump cavity with at least a 66 gallon (~250 liter) capacity. In another embodiment, the capacity of the sump cavity is about 73 gallons (~276 liters).

The total load capacity on the drum supporting grates is preferably at least 3,000 pounds (~1,361 kg). Regrind polymer can be used to achieve this load capacity. More preferably, the total load capacity on the drum supporting grates is preferably at least 6,000 pounds (~2,722 kg). Virgin resins are usually required to obtain higher load capacities. Due to the high strength of structural foam material and the spacing of the risers, it is also possible for the total load capacity on the drum supporting grates to be 10,000 pounds (~4,536 kg) or more.

Figure 5:
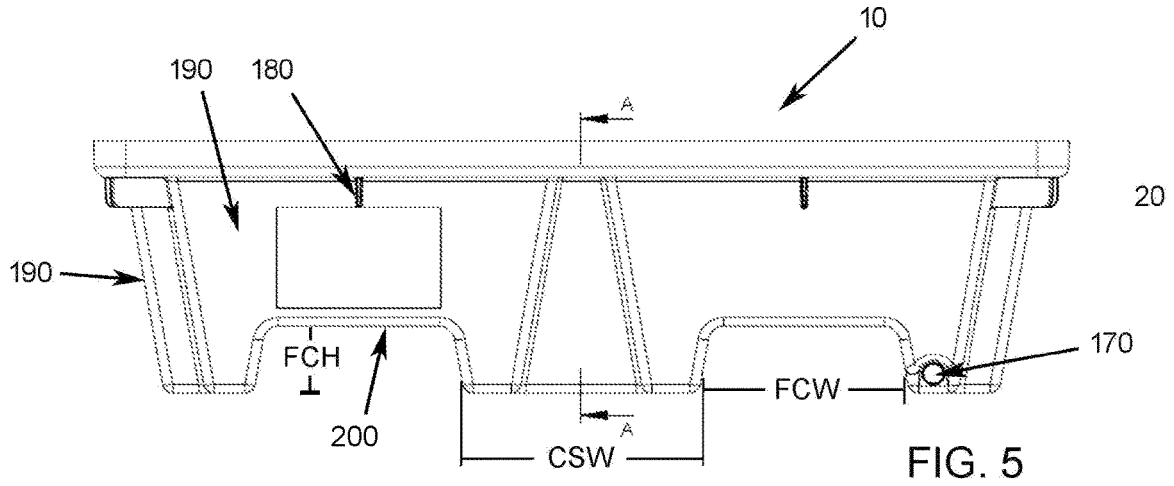
FIG. 5 is a front plan view of the spill pallet shown in FIG. 1.

FIG. 5 shows a front plan view of the spill pallet 10 shown in FIG. 1. Preferably, the base 20 has a front width W between 46" (~117 cm) and 48" (~122 cm). In the presently most preferred embodiment, the front width W of the base 20 is about 47.50" (~119.4 cm). A drain 160, which is closed with a threaded plug 170 for shipping, can be provided in the base 20, if desired. It will be appreciated that multiple drains 160 can be provided, if desired.

Figure 6:
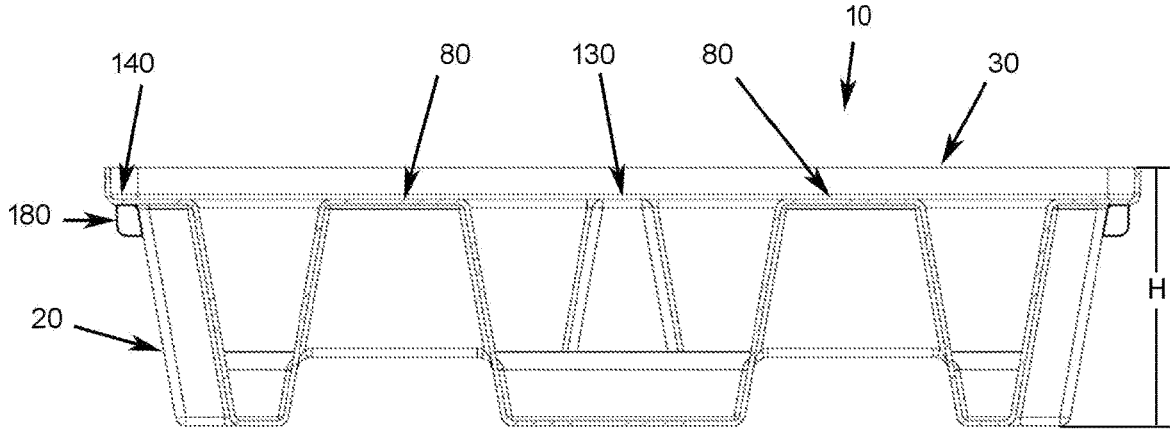
FIG. 6 is a section view in the direction of the arrows taken through the line A-A in FIG. 5.

FIG. 6 is a section view in the direction of the arrows taken through the line A-A in FIG. 5. FIG. 6 shows that the grate 30 is supported by the rim 140 and grate-supporting surfaces 80 and 130 (the grate 30 is also supported by grate-supporting surfaces 60 and 100, which are not clearly visible in FIG. 6).

Figure 7:
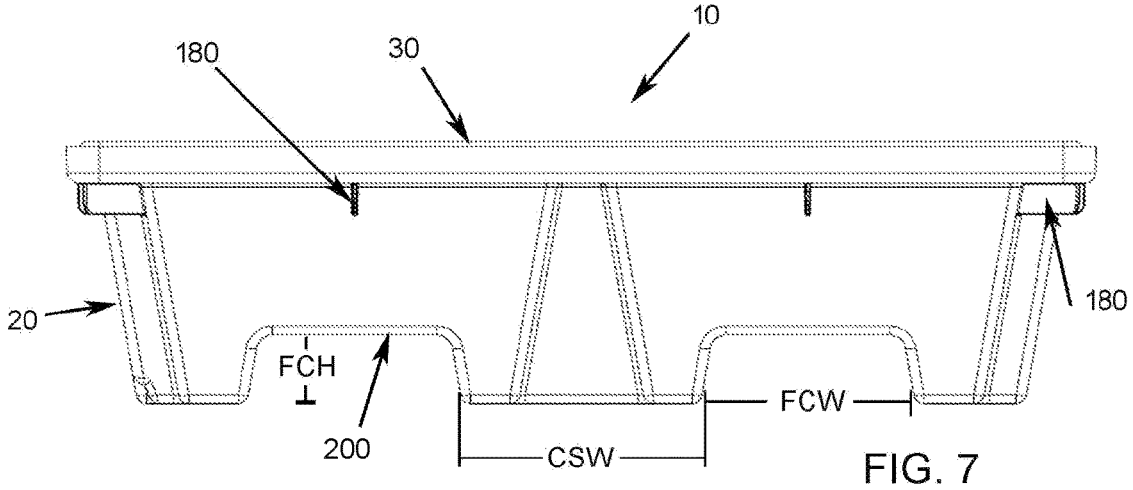
FIG. 7 is a right side plan view of the spill pallet shown in FIG. 1.

FIG. 7 shows a right side plan view of the spill pallet 10 shown in FIG. 1. Preferably, the base 20 has a side length L between 45" (~114 cm) and 52" (~132 cm), and more preferably about 48" (~122 cm) to 50" (~127 cm) and most preferably about 49" (~125 cm).

As shown in FIGS. 5-7, the base 20 preferably has an overall height H of between 10" (~25 cm) and 14" (~35.6 cm), and more preferably about 12.25" (~31.1 cm). The upper edge 150 of the base 20 preferably terminates slightly less than about 1.5" (~3.8 cm) above the rim 140 and thus the top drum-supporting surface of the grates 30 are about 0.25" (~6.5 mm) above the upper edge 150. Ribs 180 are provided below the rim on the outside 190 of the base 20. The ribs 180 allow air to enter between bases 20 that are stacked one atop another in a nested configuration, which allows for easier separation.

FIGS. 5 and 7 also show fork channels 200 that are accessible from the front side and the right side of the base 20. The fork channels 200 each preferably have a fork cavity height FCH of about 3" (~8 cm) to about 3.5" (~8.9 cm), and a fork cavity width FEW of about 9" (~22.9 cm) to about 10.5" (~27 cm), and are separated by a center support having a center support width CSW of about 10" (25.4 cm) to about 12.5" (~32 cm). In the most preferred embodiment, the fork cavity height FCH is about 3.25" (~8.3 cm), a fork cavity width FCW of about 9.3" (~23.6 cm) and a center support width CSW of about 11.5" (~29.2 cm). The centers of the fork channels 200 are preferably about 21.6" (~54.9 cm) from each other.

The fork channel dimensions advantageously permit the spill pallet 10 to be lifted not only by a standard fork lift truck, but also by a standard pallet jack. In prior art spill pallets, the spacing and size of the fork cavities in the base did not accommodate a pallet jack, meaning that stacks of spill pallets or spill pallets supporting drums could only be moved using a forklift.

In the illustrated embodiment, the spill pallet 10 is a four-way spill pallet, meaning that the forks of either pallet jacks or forklifts can approach and be received within the fork channels 200 on all four sides. It will be appreciated that in an alternative embodiment (i.e., as illustrated in the priority application, which is hereby incorporated by reference in its entirety), the spill pallet could be configured to be a two-way spill pallet, meaning that that the forks of either pallet jacks or forklifts can approach and be received within the fork channels on only two opposing sides, but not on the other two opposing sides. In yet another alternative embodiment (not illustrated), the spill pallet can be configured to be a modified four-way spill pallet, meaning that the forks of forklifts can approach and be received within the fork channels on either of two opposed sides, and the forks of a pallet jack can approach and be received within the fork channels on either of the other two opposed sides.

Figure 8:
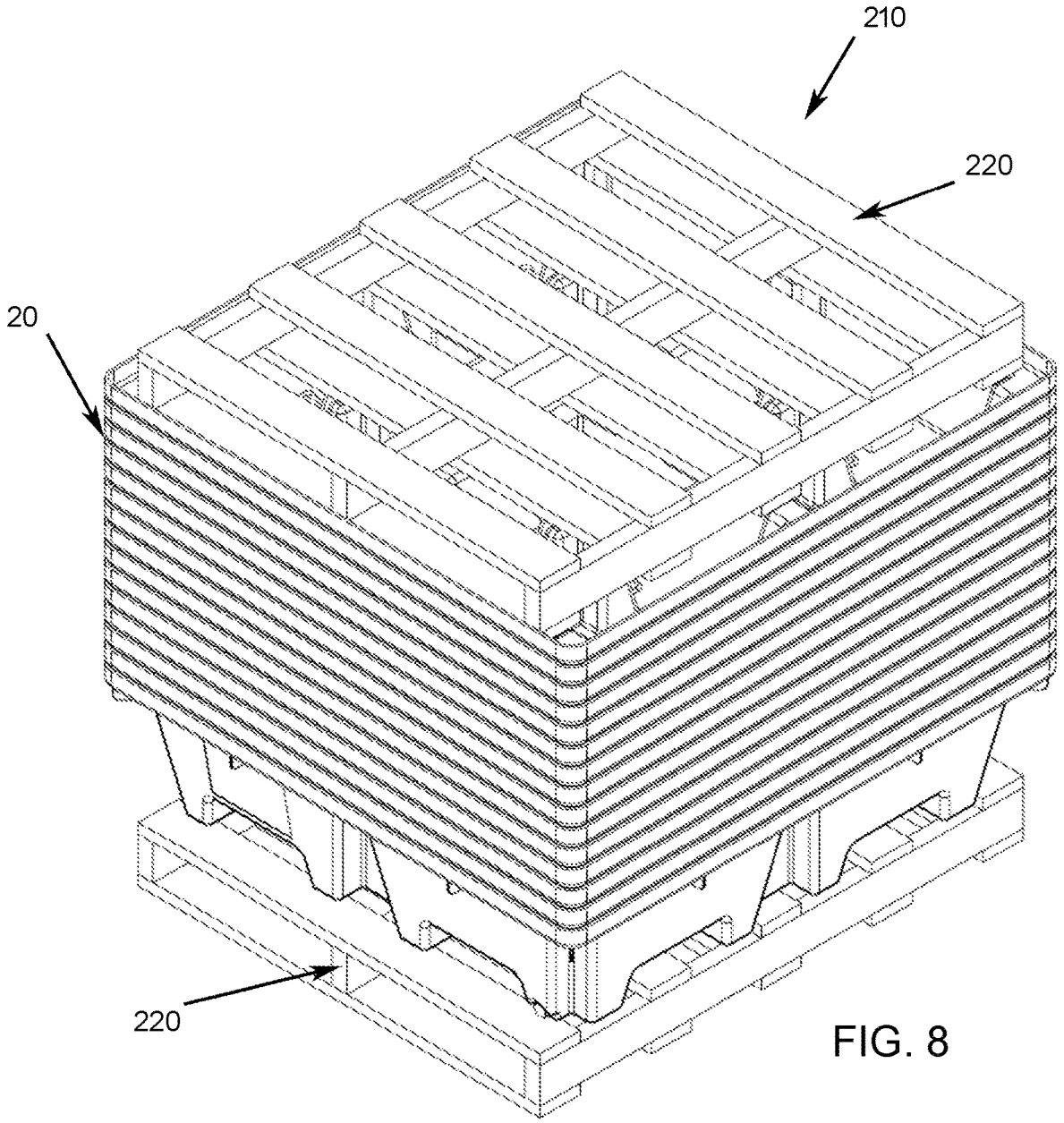
FIG. 8 is a perspective view of a stack containing fifteen bases nested together on a wooden pallets for shipping and/or storage (an additional wooden pallet is shown on top of the stack to show that a second stack can be placed atop the stack).
Figure 9:
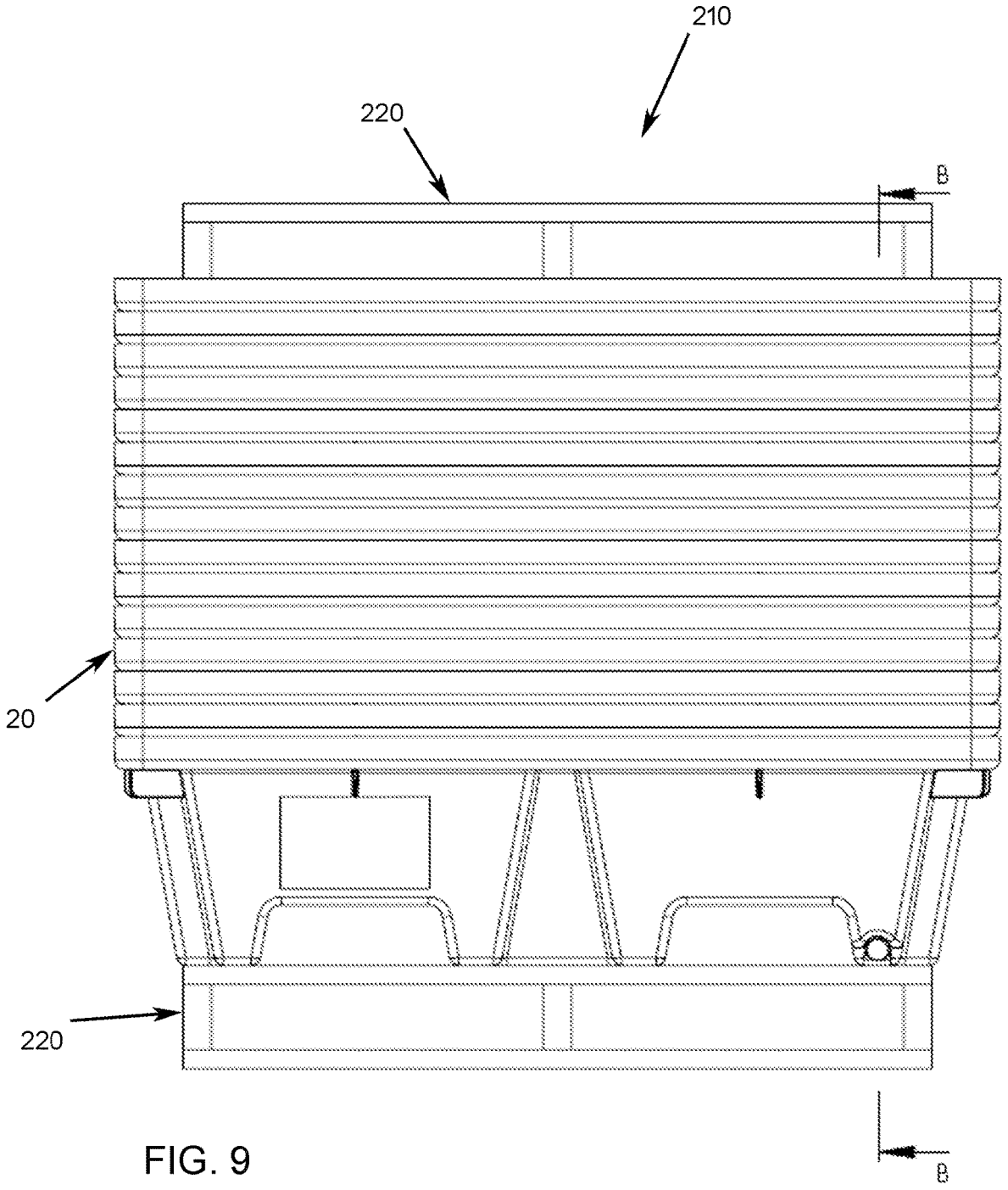
FIG. 9 is a front plan view of the stack shown in FIG. 8.
Figure 10:
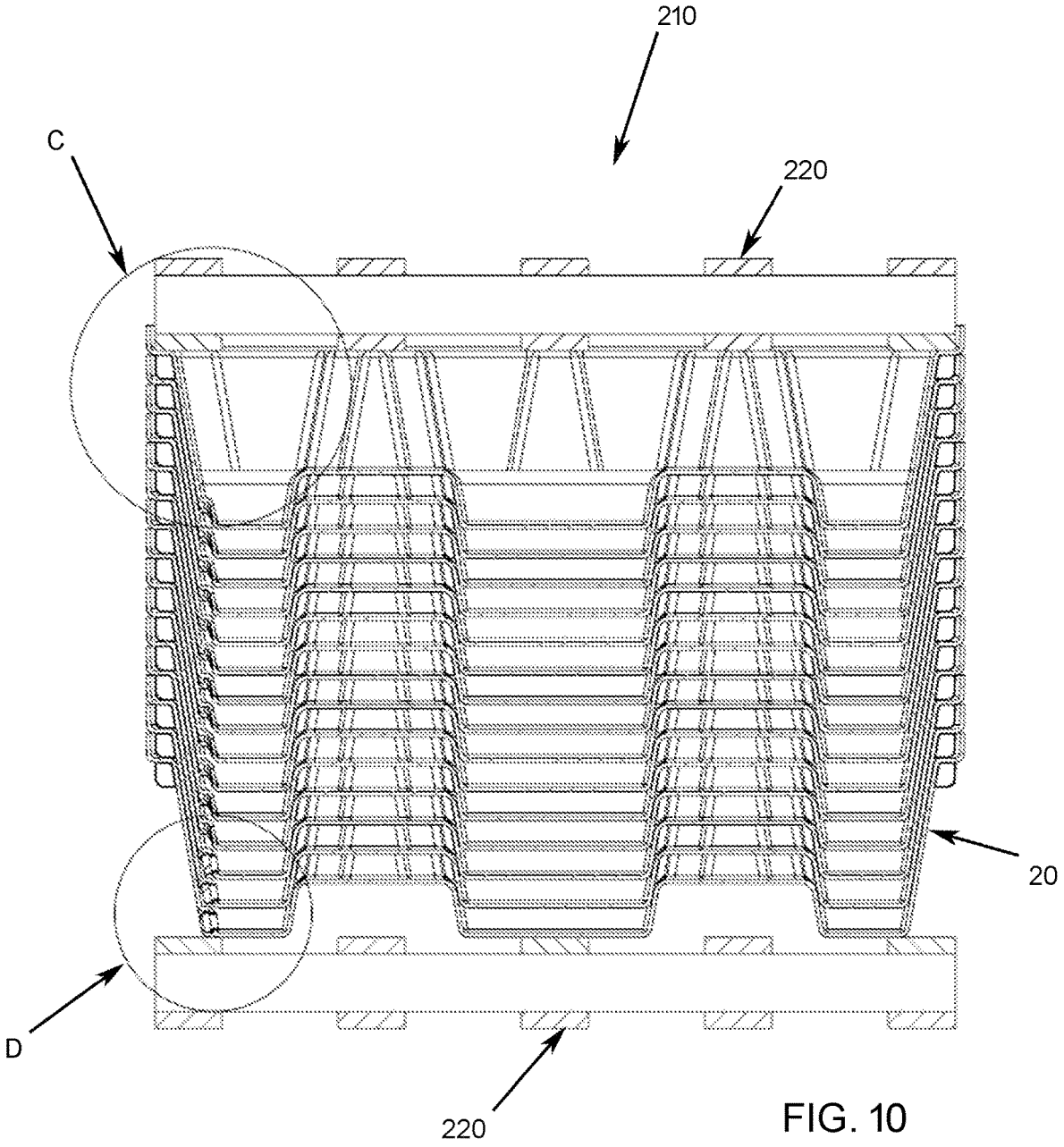
FIG. 10 is a section view in the direction of the arrows taken through the line B-B in FIG. 9.
Figure 11:
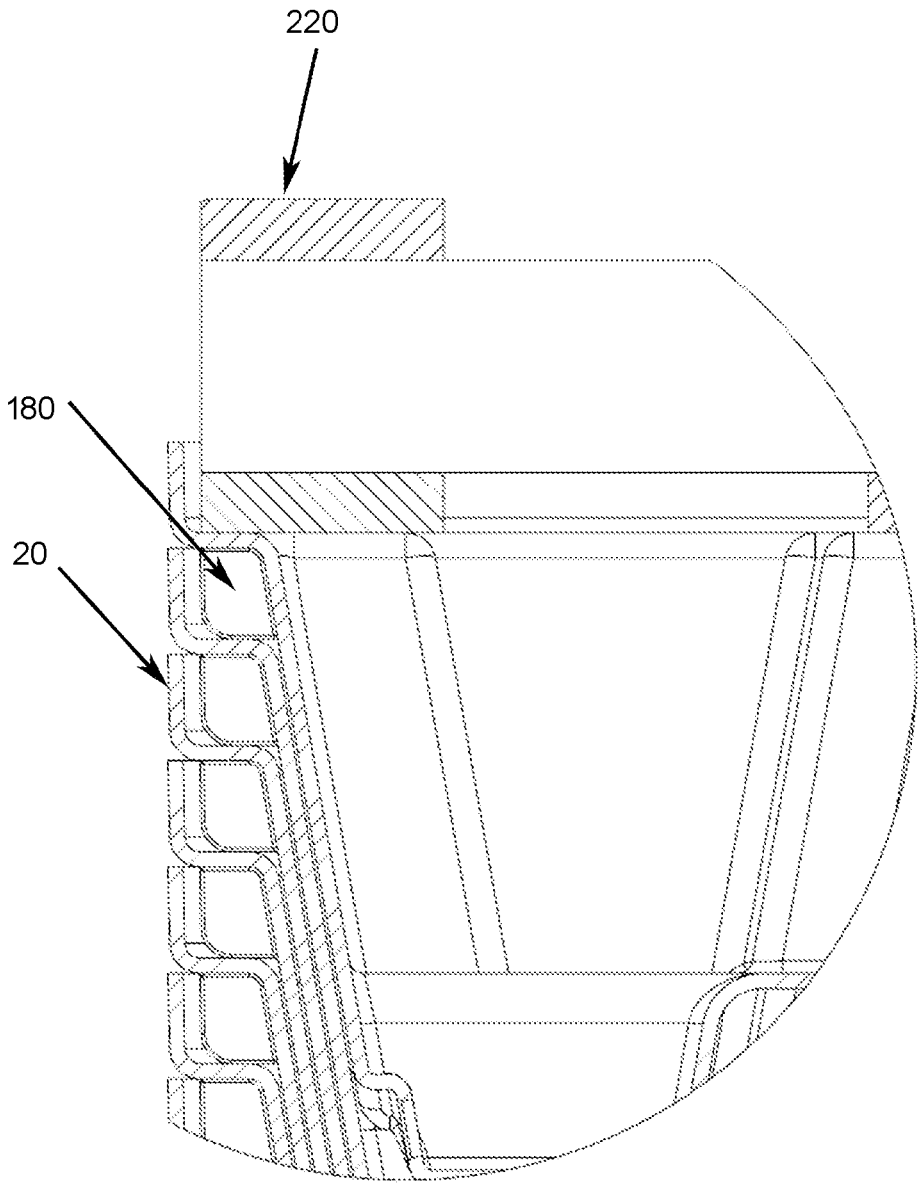
FIG. 11 is an enlarged view of the portion of FIG. 9 within circle C.
Figure 12:
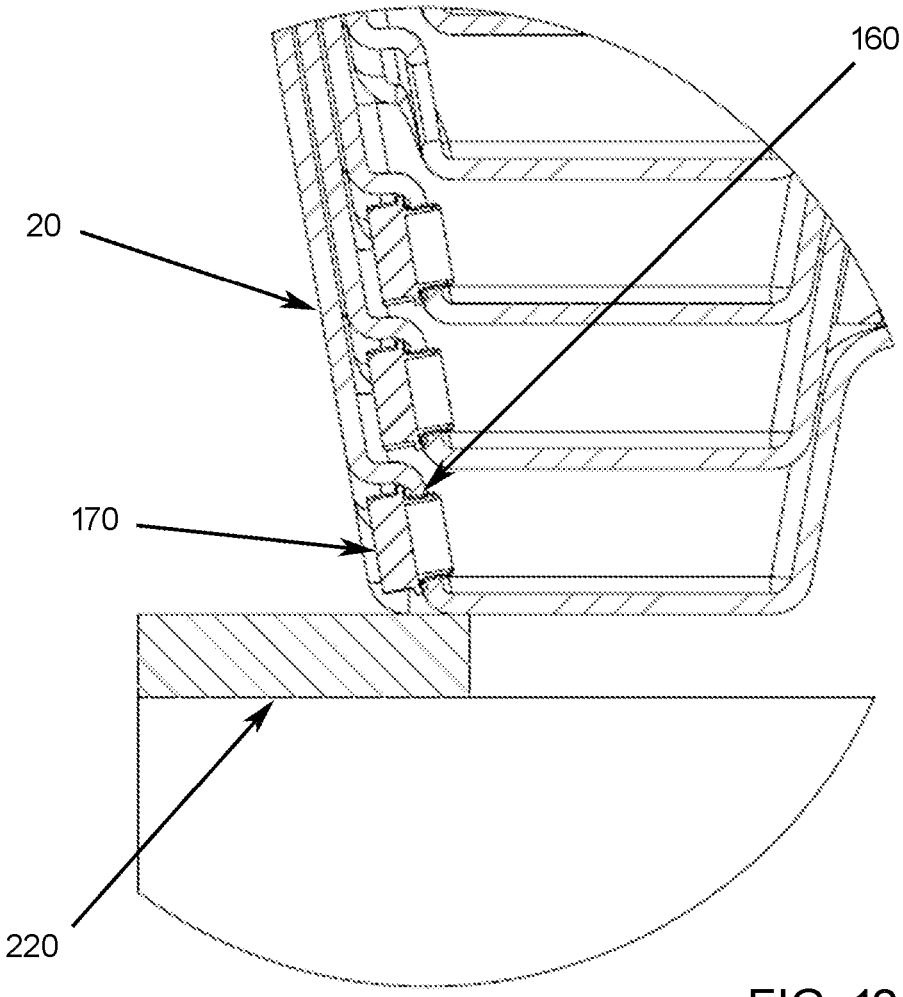
FIG. 12 is an enlarged view of the portion of FIG. 9 within circle D.

FIG. 8 is a perspective view of a stack 210 containing fifteen bases nested together on a wooden pallet 220 for shipping and/or storage. An additional wooden pallet 220 is shown on top of the stack 210 to show that a second stack (see FIG. 13) can be placed atop the stack 210. FIG. 9 is a front plan view of the stack shown in FIG. 8. There are fifteen (15) bases 20 in the stack 210. FIG. 10 is a section view in the direction of the arrows taken through the line B-B in FIG. 9. FIG. 11 is an enlarged view of the portion of FIG. 9 within circle C. FIG. 12 is an enlarged view of the portion of FIG. 9 within circle D.

Figure 13:
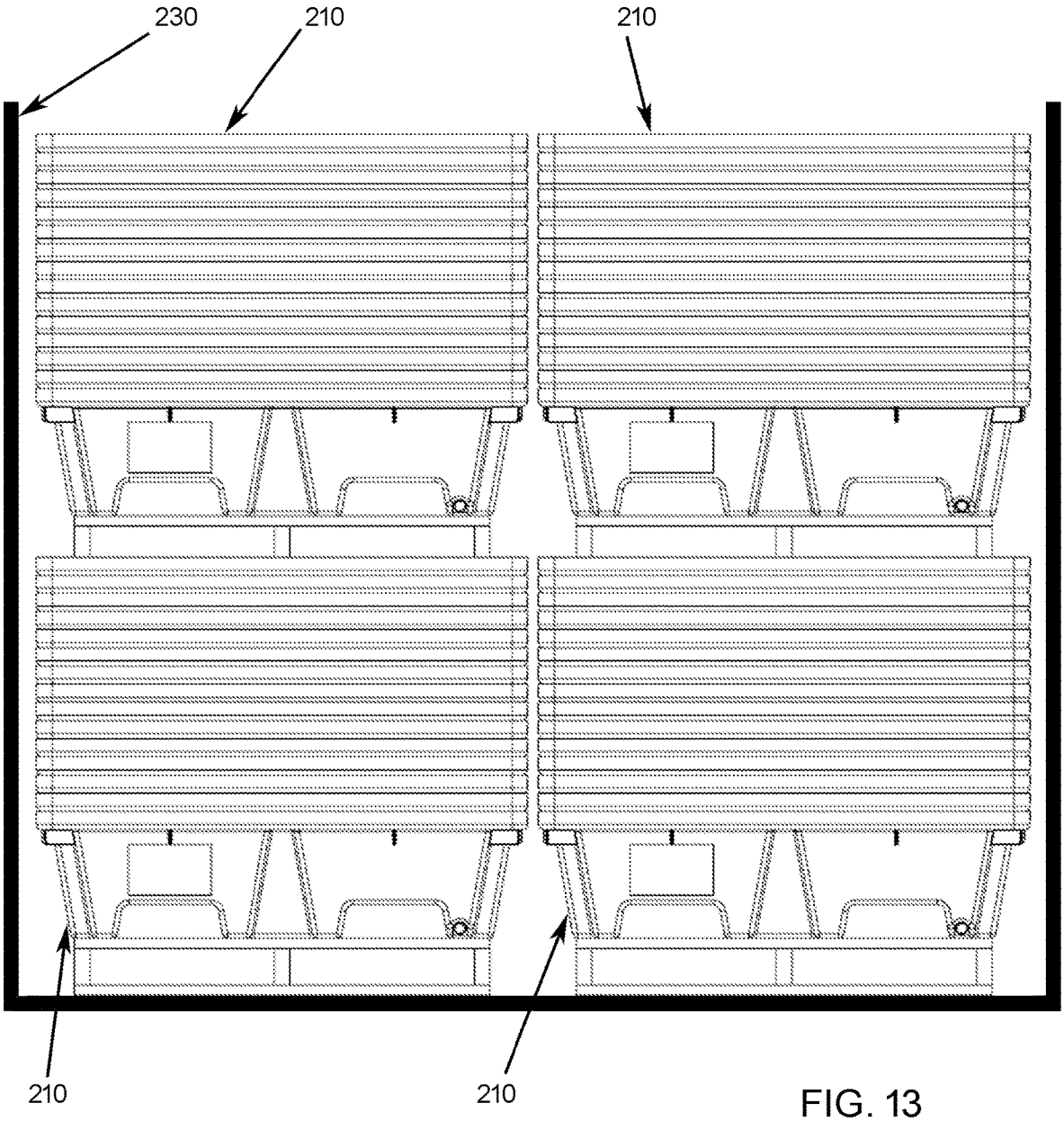
FIG. 13 is a schematic view of four stacks, each containing fifteen bases nested together on wooden pallets, placed side-by-side and one atop another within a semi-trailer for shipping.

As best shown in FIG. 13, the front width W dimension of the bases 20 preferably allows two stacks 210 of stacked/nested bases to be placed side-by-side in within the interior width of a trailer 230 to form a partial load. This minimizes shipping costs by maximizing the number of spill pallets 10 that can be shipped in a single load. As shown in FIG. 13, two stacks 210 of bases 20 can also be stacked one atop another within the trailer 230. As shown in FIG. 1, the grates 30 are flat, and thus can be shipped in one or more separate stacks that takes up very little shipping space.

In the illustrated embodiment shown in FIG. 13, the total height of the stack 210, including the wooden pallets 210, is about 42.25" (~107.3 cm), which allows them to be stacked two high. Thus, a single semi-trailer can carry a load consisting of 780 units (52 stacks). The number of spill pallets 210 that can be included within a stack 210 for shipping or storage is preferably between eight and twenty-four.

It will be appreciated that the dimensions of the spill pallet 10 can be adjusted, as desired, to maximize the amount of spill pallets that can be shipped in trucks or international shipping containers.

Additional advantages and modifications will readily occur to those skilled in the art. Therefore, the invention in its broader aspects is not limited to the specific details and illustrative examples shown and described herein. Accordingly, various modifications may be made without departing from the spirit or scope of the general inventive concept as defined by the appended claims and their equivalents.

What is claimed is:

1. A spill pallet comprising:

a continuous, unitary, liftable sump-defining base, said base having a bottom, four side walls extending from and surrounding the bottom and terminating in an upper edge, a plurality of risers extending from the bottom, each of said plurality of risers being spaced apart from side walls and having a grate-supporting surface, corner pillars integrally formed in the side walls at each corner of the base, each of said corner pillars having a grate-supporting surface, side pillars integrally formed in the side walls of the base, each of said side pillars having a grate-supporting surface, and a rim formed in the side walls below the upper edge; and one or more perforated drum-supporting grates that is/are supported on the grate-supporting surfaces of the plurality of risers, the corner pillars, the side pillars and the rim of the base;

wherein a plurality of ribs are provided on the outside of the side walls of the base, said ribs extending from and below the rim, wherein the base includes fork channels below the bottom that are separated by a center support of the base, wherein a plurality of additional support structures extend from the bottom, and wherein each of said additional support structures includes a grate-supporting surface for supporting the one or more drum-supporting grates, and wherein four risers extend from the bottom, wherein two additional support structures extend from the bottom, and wherein two drum-supporting grates are supported in a side-by-side configuration on the grate-supporting surfaces of the four risers, the corner pillars, the side pillars, the two additional support structures and the rim of the base.

2. The spill pallet according to claim 1, wherein the grate-supporting surfaces of the four risers are in the shape Greek crosses.

3. The spill pallet according to claim 2, wherein the Greek crosses are located above the fork channels.

4. The spill pallet according to claim 1, wherein the grate-supporting surfaces of the two additional support structures are rectangular, and wherein both of the two drum-supporting grates are supported, at least in part, by each of the two additional support structures supports.

5. The spill pallet according to claim 1, wherein the base and the one or more drum-supporting grates are made of structural foam.

6. The spill pallet according to claim 5, wherein the structural foam is a thermoplastic structural foam comprising a high-density polyethylene resin.

7. The spill pallet according to claim 6, wherein the thermoplastic structural foam comprises regrind polymer.

8. The spill pallet according to claim 7, wherein the total load capacity on the two drum-supporting grates, when the two drum-supporting grates are supported by the base, is at least 3,000 pounds (~1,361 kg).

9. The spill pallet according to claim 1, wherein the one or more drum-supporting grates are capable of support up to four 55-gallon (~208 liter) drums, and the sump has a capacity of at least 66 gallons (~250 liters).

10. The spill pallet according to claim 1, wherein the base further comprises a drain.

11. The spill pallet according to claim 1, wherein the base has a nominal wall thickness of about 0.25" (~0.64 cm).

12. A partial load within a truck, trailer or container having an interior width dimension of between 92" (~233.7 cm) and 102" (~259.1 cm), the partial load comprising a plurality of spill pallets according to claim 1, wherein the bases of the spill pallets are arranged in at least two stacks, wherein each of the at least two stacks comprises a portion of the bases of the plurality of spill pallets, said bases being stacked one atop another such that each base in each stack, except for the bottom-most base in each stack, is partially nested within the base on which it is stacked, and wherein the at least two stacks are arranged side-by-side within the interior width dimension of the truck, trailer or container.

13. The partial load according to claim 12, wherein the partial load comprises two additional stacks of bases, each of which is arranged on top of one of the at least two stacks arranged side-by-side within the interior width dimension of the truck, trailer or container.

14. A spill pallet comprising:

a continuous, unitary, liftable sump-defining base, said base having a bottom, four side walls extending from and surrounding the bottom and terminating in an upper edge, a plurality of risers extending from the bottom, each of said plurality of risers being spaced apart from side walls and having a grate-supporting surface, corner pillars integrally formed in the side walls at each corner of the base, each of said corner pillars having a grate-supporting surface, side pillars integrally formed in the side walls of the base, each of said side pillars having a grate-supporting surface, and a rim formed in the side walls below the upper edge; and one or more perforated drum-supporting grates that is/are supported on the grate-supporting surfaces of the plurality of risers, the corner pillars, the side pillars and the rim of the base;

wherein a plurality of ribs are provided on the outside of the side walls of the base, said ribs extending from and below the rim, wherein the base includes fork channels below the bottom that are separated by a center support of the base, and wherein the fork channels are accessible from all four sides of the base.

15. The spill pallet according to claim 14, wherein the fork channels each have a fork cavity height of about 3" (~8 cm) to about 3.5" (~8.9 cm), and a fork cavity width of about 9" (~22.9 cm) to about 10.5" (~27 cm), and wherein the center support separating the fork cavities has width of about 10" (25.4 cm) to about 12.5" (~32 cm).

16. The spill pallet according to claim 14, wherein the base has an overall width of about 45" (114 cm) to about 48" (122 cm), wherein the base has an overall length of about 45" (114 cm) to about 52" (132 cm), and wherein the base has a height of about 10" (25.4 cm) to about 13" (33 cm).

17. The spill pallet according to claim 16, wherein the base is configured such that it is stackable on and partially nestable within a second identical base to form a stack.

18. The spill pallet according to claim 14, wherein the base further comprises a drain.

19. The spill pallet according to claim 14, wherein the base has a nominal wall thickness of about 0.25" (~0.64 cm).

20. A partial load within a truck, trailer or container having an interior width dimension of between 92" (~233.7 cm) and 102" (~259.1 cm), the partial load comprising a plurality of spill pallets according to claim 14, wherein the bases of the spill pallets are arranged in at least two stacks, wherein each of the at least two stacks comprises a portion of the bases of the plurality of spill pallets, said bases being stacked one atop another such that each base in each stack, except for the bottom-most base in each stack, is partially nested within the base on which it is stacked, and wherein the at least two stacks are arranged side-by-side within the interior width dimension of the truck, trailer or container.

21. The partial load according to claim 20, wherein the partial load comprises two additional stacks of bases, each of which is arranged on top of one of the at least two stacks arranged side-by-side within the interior width dimension of the truck, trailer or container.

22. A spill pallet comprising:

a continuous, unitary, liftable sump-defining base, said base having a bottom, four side walls extending from and surrounding the bottom and terminating in an upper edge, four risers extending from the bottom, each of said four risers being spaced apart from side walls and having a grate-supporting surface, two additional support structures extending from the bottom, each of said two additional support structures being spaced apart from the side walls and having a grate-supporting surface, four corner pillars integrally formed in the side walls at each corner of the base, each of said four corner pillars having a grate-supporting surface, side pillars integrally formed in each of the four side walls of the base, each of said side pillars having a grate-supporting surface, and a rim formed in the side walls below the upper edge; and two perforated drum-supporting grates that are supported in a side-by-side configuration on the grate-supporting surfaces of the four risers, the four corner pillars, the side pillars, the two additional support structures and the rim of the base;

wherein a plurality of ribs are provided on the outside of the side walls of the base, said ribs extending from and below the rim, wherein the base includes fork channels below the bottom that are separated by a center support of the base, wherein the base and the two drum-supporting grates are made of structural foam, wherein the fork channels are accessible from all four sides of the base, wherein the fork channels each have a fork cavity height of about 3" (~8 cm) to about 3.5" (~8.9 cm), wherein the fork channels have a fork cavity width of about 9" (~22.9 cm) to about 10.5" (~27 cm), wherein the center support separating the fork cavities has width of about 10" (25.4 cm) to about 12.5" (~32 cm), wherein the base has an overall width of about 45" (114 cm) to about 48" (122 cm), wherein the base has an overall length of about 45" (114 cm) to about 52" (132 cm), and wherein the base has a height of about 10" (25.4 cm) to about 13" (33 cm).

* * * * *